US007128229B2

(12) United States Patent
Delmon

(10) Patent No.: US 7,128,229 B2
(45) Date of Patent: Oct. 31, 2006

(54) PLAY RECOVERY ASSEMBLY ADAPTED TO CONTAIN A FLUID

(75) Inventor: Marc Delmon, Le Bex D'Ytrac (FR)

(73) Assignee: Qualipac, Neuilly-sur-Seine (FR)

( * ) Notice: Subject to any disclaimer, the term of this patent is extended or adjusted under 35 U.S.C. 154(b) by 388 days.

(21) Appl. No.: 10/682,879

(22) Filed: Oct. 14, 2003

(65) Prior Publication Data

US 2004/0089661 A1 May 13, 2004

(30) Foreign Application Priority Data

Oct. 29, 2002 (FR) ..... 02 13553

(51) Int. Cl.
*B65D 23/00* (2006.01)
*A47J 41/02* (2006.01)

(52) U.S. Cl. ..... 215/400; 215/12.1

(58) Field of Classification Search ..... 215/332, 215/222, 342, 335, 386, 373, 356, 341, 11.3, 215/12.1, 395

See application file for complete search history.

(56) References Cited

U.S. PATENT DOCUMENTS 3,716,161 A * 2/1973 Julian et al. ..... 215/330
4,705,053 A * 11/1987 Goncalves ..... 132/218
5,002,415 A * 3/1991 Gueret ..... 401/126
6,474,891 B1 * 11/2002 Liu ..... 401/174

FOREIGN PATENT DOCUMENTS

| | | |
|---|---|---|
| DE | 1 227 198 | 10/1966 |
| FR | 1 340 337 | 10/1963 |
| GB | 2 152 468 | 8/1985 |

* cited by examiner

*Primary Examiner*—Jes F. Pascua
*Assistant Examiner*—Shawn M. Braden
(74) *Attorney, Agent, or Firm*—Young & Thompson

(57) ABSTRACT

Assembly (1) adapted to contain a fluid, in particular a cosmetic fluid, including a bottle (2) extending in an elongate direction (6) and including a neck (30), a substantially tubular base (4) substantially covering the bottle and retaining part adapted to hold the bottle in the base. The retaining part including a collar (16) bearing on the bottle about its neck, a tubular member (8) and hooking part (18, 20). The tubular member (8) includes elastic part (10) disposed between a first portion (12) and a second portion (14) of the tubular member in order to be able to vary the distance between the first portion (12) and the second portion (14) of the tubular member, the tubular member (8) being connected to the base (4) by its second portion (14). The hooking part is adapted to secure the collar (16) to the first portion (12) of the tubular member.

6 Claims, 2 Drawing Sheets

PLAY RECOVERY ASSEMBLY ADAPTED TO CONTAIN A FLUID

BACKGROUND OF THE INVENTION

The invention relates to an assembly adapted to contain a fluid, in particular a cosmetic fluid.

Assemblies are conventionally known which comprise:

a bottle extending in an elongate direction and comprising a neck via which the fluid is adapted to flow;

a substantially tubular base extending in said elongate direction, substantially covering the bottle and having a base on which the bottle rests in contact;

retaining means adapted to hold the bottle in the base.

The base therefore makes it possible to embellish the bottle. In order to reduce production costs, however, bottles (or even bases) having dimensional tolerances of some 5% are currently used. It is then very difficult to retain the bottle in the base in a satisfactory manner (and in particular to prevent any unexpected relative displacement) while ensuring precise mounting of the visible components of the assembly in order to obtain excellent aesthetic qualities.

SUMMARY OF THE INVENTION

According to the invention the retaining means comprise, in order to resolve this problem:

a collar bearing on the bottle about its neck;

a tubular member extending in the elongate direction, said tubular member comprising elastic means disposed between a first portion and a second portion of the tubular member in order to be able to vary the distance between said first portion and said second portion of the tubular member, said tubular member being connected to said base by means of its second portion;

hooking means adapted to secure the collar to the first portion of the tubular member.

The elastic means thus make it possible to absorb the dimensional variations of the bottle and/or the base so that the bottle always rests on the base in the same way (in the same relative position in the elongate direction) and there is no play between the collar and the bottle.

In order to facilitate the fastening of the collar on the first portion of the tubular member, in accordance with an advantageous characteristic feature of the invention, the collar is secured on the first portion of the tubular member by means of bayonet hooking means.

After engagement of the collar about the neck of the bottle, it is sufficient to rotate this collar to secure the bottle.

In order to obtain a simple, robust and inexpensive coupling between the tubular member (in particular its second portion) and the base, the assembly advantageously comprises snap-locking means and the second portion of the tubular member is tightly interposed between the base and the bottle perpendicular to said elongate direction.

As a result, therefore, of the snap locking, the coupling between the tubular member and the base is obtained automatically when the tubular member is inserted into the base and its release is no longer possible once the bottle is inserted in the tubular member.

Alternatively, said tubular member could be integrated in the base, in other words integral with the base to form a monobloc assembly.

The number of components and therefore the number of assembly operations is thus reduced.

According to the invention, the elastic means are formed by:

a sequence of rings perpendicular to the elongate direction;

a sequence of bridges connecting two successive rings, disposed such that two successive bridges present an angular offset radially to the elongate direction.

These elastic means are particularly appropriate when a relative displacement between the first and the second portion of the tubular member is desired, substantially by translation in the elongate direction.

BRIEF DESCRIPTION OF THE DRAWINGS

The invention is set out in further detail in the following description, made with reference to the accompanying drawings, in which:

FIGS. 1 to 3 show an assembly 1 substantially comprising a bottle 2, a base 4 forming an embellishment, a retaining collar 16 and a tubular member 8 all extending substantially in an elongate direction 6.

DETAILED DESCRIPTION OF THE PREFERRED EMBODIMENTS

Figure 1:
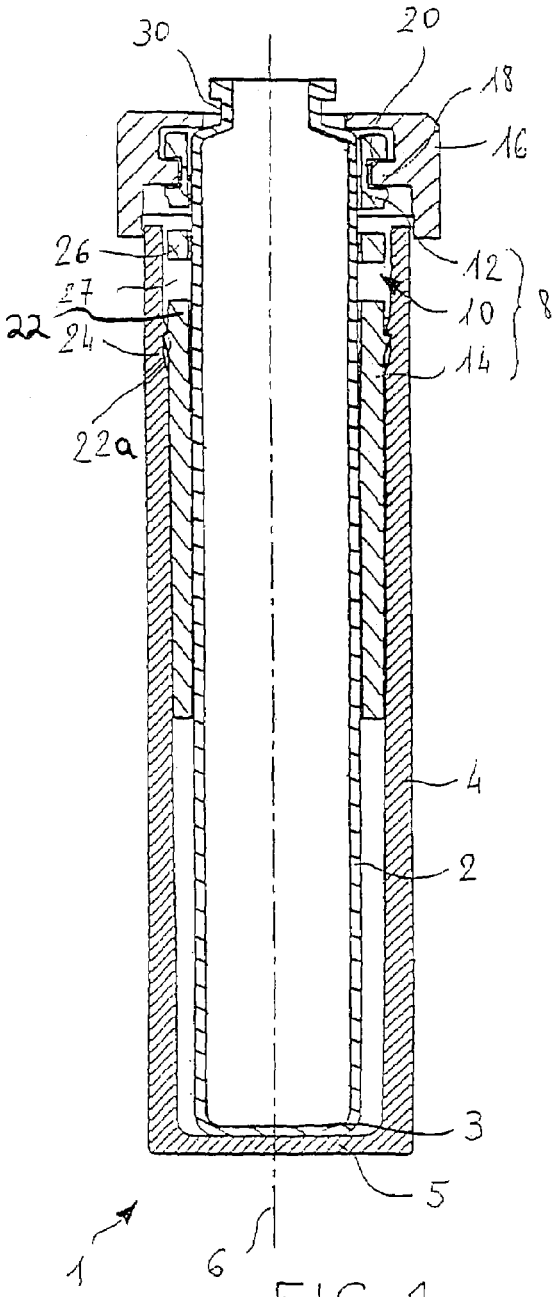
FIG. 1 is a view in median section of an assembly of the invention.

The bottle 2 is provided with a neck 30 via which the fluid contained in the bottle is adapted to flow.

The base 4 substantially covers the bottle 2. It is substantially tubular and provided with a base 5 on which the base 3 of the bottle 2 rests.

The tubular member 8 comprises a first portion 12 and a second portion 14 connected by a traction spring 10. It is tightly inserted in the base 4 and its second portion 14 externally comprises a chamfered shoulder 22 cooperating with a groove 24 of complementary shape provided in the base 4. The chamfered portion 22*a* of the shoulder facilitates the insertion of the shoulder 22 in the groove 24 by elastic deformation of the tubular member 8.

Once the shoulder 22 has been inserted in the groove 24, the bottle 2 is tightly inserted in the tubular member 8 and the tubular member cannot be withdrawn from the base 4.

In order to hold the bottle 2 in the base 4, the collar 16 is disposed around the neck 30 then brought to bear on the bottle 2. The collar 16 is provided with lugs 18 which are inserted in a groove 20 provided at the free end of the outer surface of the first portion 12. The lugs 18 cooperate with the groove 20 to form bayonet hooking means such that by rotating the collar 16, the spring 10 is stretched and the hooking means are activated. The lugs 18 are then held in the groove 20.

After releasing the collar 16, said collar therefore comes to bear on the bottle 2 about the neck 30 under the action of the spring 10, and consequently holds the base 3 of the bottle 2 in abutment under pressure against the bottom 5 of the base 4.

The stretching of the spring 10 varies as a function of the length of the bottle 2 in the elongate direction 6.

Said spring 10 is formed by a sequence of rings 26 and spaces 27 superposed in the elongate direction 6. The successive rings 26 are connected by bridges 28 extending into the spaces 27 parallel to the elongate direction 6. The bridges 28 extending into two consecutive spaces 27 are angularly offset by an angle α which is not zero radially to the elongate direction such that the stretching of the spring 10 is chiefly obtained by deformation of the rings 26.

Figure 2:
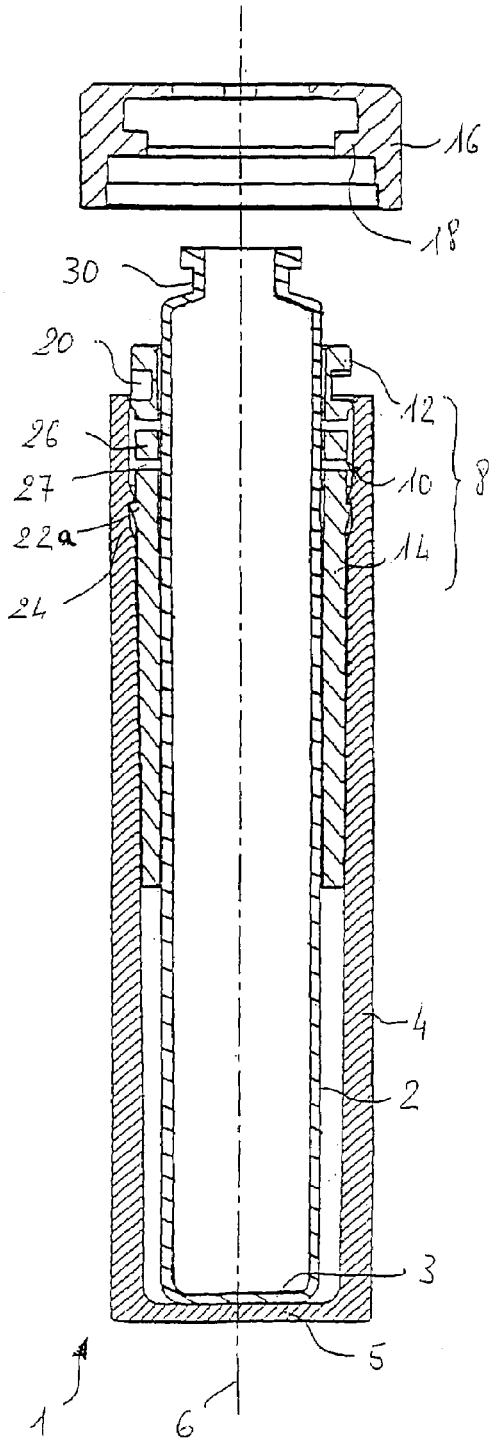
FIG. 2 is a view similar to FIG. 1 of the assembly prior to final mounting.
Figure 3:
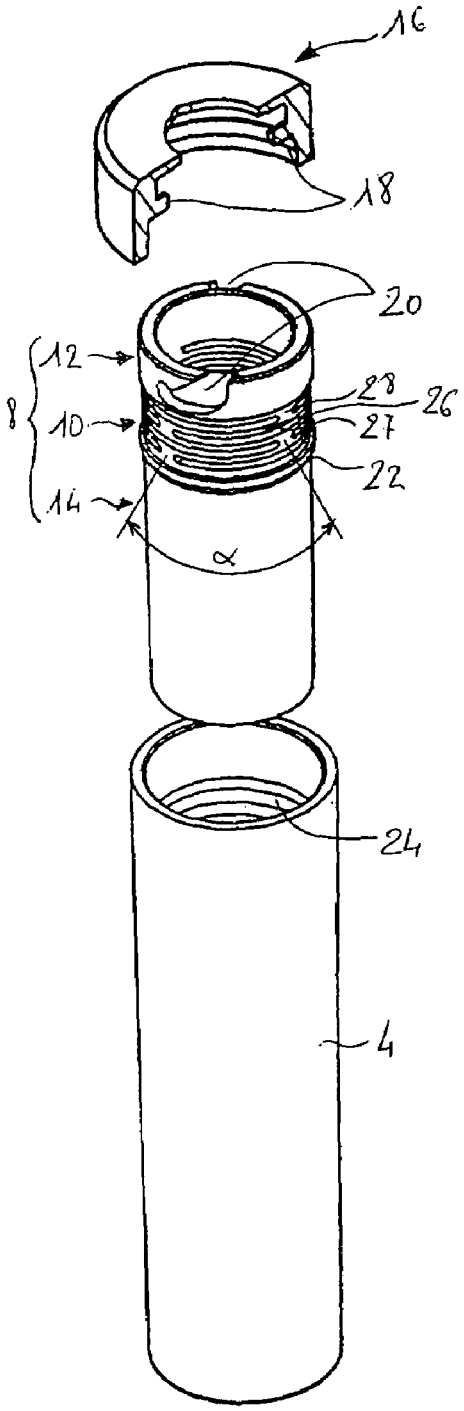
FIG. 3 is an exploded perspective view of the assembly without the bottle.
Figure 4:
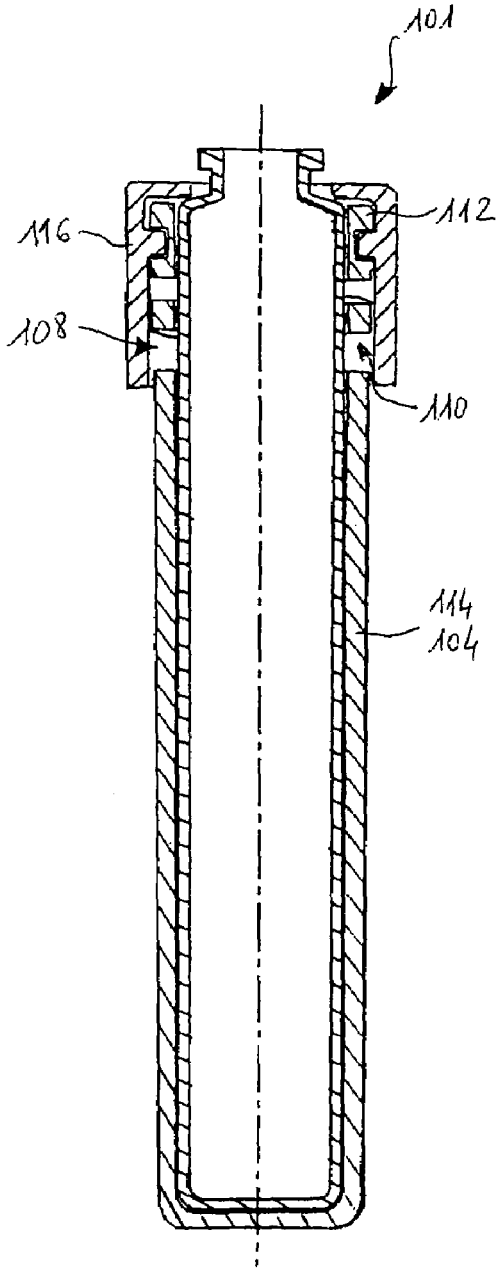
FIG. 4 is a view similar to FIG. 1 of a variant.

FIG. 4 shows a variant. The reference numerals corresponding to those of FIGS. 1 to 3 are increased by 100.

The assembly 101 differs from the assembly 1 chiefly in that the tubular member 108 is integral with the base 104, the second portion 114 and the base 104 being merged. The spring 110 is therefore interposed between the first portion 112 and the base 104. The spring 110, the first portion 112 and the base 104 thus form an integral monobloc member.

The shape of the collar 116 has consequently been slightly modified.

Bearing in mind the mechanical properties that the spring 10, 110 must possess the tubular member 8, 108 is advantageously made from polyoxymethylene, polyacetal or polyformaldehyde (POM).

I claim:

1. An assembly adapted to contain a fluid, in particular a cosmetic fluid, comprising:

a bottle extending in an elongate direction and comprising a neck via which the fluid is adapted to flow;

a substantially tubular base extending in said elongate direction, substantially covering the bottle and having a base against which the bottle rests in contact;

a retaining part adapted to hold the bottle in the base, wherein the retaining part comprises:

a collar;

a tubular member extending in the elongate direction, said tubular member comprising a traction elastic part between a first portion and a second portion of the tubular member in order to be stretched to vary the distance between said first portion and said second portion of the tubular member, said tubular member being coupled to said base by its second portion; and a hooking part adapted to secure the collar to the first portion of the tubular member, wherein, said collar bears on the bottle about the bottle neck under action of said traction elastic part.

2. The assembly according to claim 1, wherein the collar is secured on the first portion of the tubular member by a bayonet hooking part.

3. The assembly according to claim 1, wherein the assembly comprises a snap-locking part adapted to couple the second portion of the tubular member to the base and in that the second portion of the tubular member is tightly interposed between the base and the bottle perpendicular to said elongate direction.

4. The assembly according to claim 1, wherein said tubular member is integral with the base.

5. The assembly according to claim 1, wherein the elastic part is formed by:

a sequence of rings perpendicular to the elongate direction;

a sequence of bridges connecting two successive rings, disposed such that two successive bridges present an angular offset radially to the elongate direction.

6. An assembly adapted to contain a fluid, in particular a cosmetic fluid, comprising:

a bottle extending in an elongate direction and comprising a neck via which the fluid is adapted to flow;

a substantially tubular base extending in said elongate direction, substantially covering the bottle and having a base against which the bottle rest in contact;

a retaining part adapted to hold the bottle in the base, wherein the retaining part comprises:

a collar bearing on the bottle about its neck;

a tubular member extending in the elongate direction, said tubular member comprising an elastic part between a first portion and a second portion of the tubular member in order to be able to vary the distance between said first portion and said second portion of the tubular member, said tubular member being coupled to said base by its second portion; and a hooking part adapted to secure the collar to the first portion of the tubular member, wherein the assembly comprises a snap-locking part adapted to couple the second portion of the tubular member is tightly interposed between the base and the bottle perpedicular to said elongate direction.

* * * * *